US007740005B2

(12) United States Patent
Hines

(10) Patent No.: US 7,740,005 B2
(45) Date of Patent: Jun. 22, 2010

(54) DIESEL FUEL INJECTOR REMOVAL TOOL

(76) Inventor: Ira Hines, 702 Lincoln St., Kissimmee, FL (US) 34741

( * ) Notice: Subject to any disclaimer, the term of this patent is extended or adjusted under 35 U.S.C. 154(b) by 0 days.

(21) Appl. No.: 12/286,657

(22) Filed: Oct. 1, 2008

(65) Prior Publication Data

US 2009/0084359 A1 Apr. 2, 2009

Related U.S. Application Data

(60) Provisional application No. 60/976,623, filed on Oct. 1, 2007.

(51) Int. Cl.
*F02M 61/14* (2006.01)
*B25B 27/00* (2006.01)

(52) U.S. Cl. ..... 123/470; 29/270

(58) Field of Classification Search ..... 29/259, 29/264, 270, 287, 280, 888.4, 255; 239/289, 239/600, 533.12; 123/470; 73/114.51; *F02M 61/14; B25B 27/00*

See application file for complete search history.

(56) References Cited

U.S. PATENT DOCUMENTS 6,035,506 A * 3/2000 Bowen ..... 29/259
6,978,527 B2 * 12/2005 Oser ..... 29/252

* cited by examiner

*Primary Examiner*—Devon C Kramer
*Assistant Examiner*—Keith Coleman
(74) *Attorney, Agent, or Firm*—Larry D. Johnson

(57) ABSTRACT

An improved tool for removal of fuel injectors from the cylinder head of a diesel engine includes a male threaded pulling shaft having a milled top, with a female threaded connector at the bottom for releasable connection to the male threads at the top of a typical fuel injector. A sleeve fits over the threaded pulling shaft so that the base of the sleeve rests against the cylinder head, and the top of the pulling shaft extends through the top of the sleeve. A drive nut engages the threads of the pulling shaft and can be threaded down the pulling shaft until the drive nut contacts the top of the sleeve, preferably adjacent an interposed washer. An open end wrench is then used to turn the drive nut against the sleeve, thereby lifting the threaded pulling shaft relative to the sleeve and removing the injector from the cylinder head. The injector can then be unscrewed from the female threaded connector.

2 Claims, 1 Drawing Sheet

DIESEL FUEL INJECTOR REMOVAL TOOL

CROSS REFERENCE TO RELATED APPLICATIONS

The present application claims the benefit of the filing date of U.S. Provisional Patent Application Ser. No. 60/976,623, filed Oct. 1, 2007.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to internal combustion engines, and more specifically to a tool that can be used to remove the fuel injector from the cylinder head of a diesel engine.

BACKGROUND INFORMATION AND DISCUSSION OF RELATED ART

Diesel engines have fuel injectors that inject fuel into a highly pressurized combustion chamber just before a controlled explosion of the fuel. The injector is typically located in a cylinder head of the motor and a tight sealing relationship must be attained between the injector and the cylinder head to prevent the pressurized gases in the combustion chamber from leaking past the fuel injector. Therefore, the fit between a bore in the cylinder head for the fuel injector and the fuel injector is typically quite close. An O-ring normally assists in providing the seal. After they have been in service for an extended period of time, the fuel injectors require replacement. However, with use, the fuel injectors require considerable force to be removed from the cylinder head because the O-ring becomes hard with time and carbon deposits build up upon the fuel injector and cylinder head and serve to bond the cylinder head and fuel injector together.

In the past, different tools have been used to remove the fuel injectors from the cylinder head with varying results. For example, one method of removing the fuel injectors was to thread a slide hammer onto the end of the fuel injector to remove the fuel injector. A slide hammer is essentially a large weight, in a form that can be gripped by a user, with a bore in the center. A long rod is inserted through the bore in the weight and the rod further comprises a rod head that will not extend through the bore of the weight. The user attaches the end of the rod to the fuel injector and repeatedly slams the weight against the rod head to remove the fuel injector.

As can be understood, a slide hammer requires a great amount of force to be exerted by the operator. Accidents with slide hammers are common, such as pinched and broken fingers and injuries from operators losing their balance while operating the slide hammer. Additionally, considerable time may be required to extract stubborn fuel injectors from cylinder heads and, in some instances, the slide hammer simply cannot exert enough force to remove the fuel injector and the entire cylinder head must be removed and replaced, which is a time-consuming and expensive operation.

U.S. Pat. No. 4,293,992 to Webb discloses a tool for removing fuel injectors from diesel engines without damaging any adjacent component parts or user's hands. The invention comprises an elongated member having a U-shaped injector engaging member at one end. The elongated member has a locating pin which is adapted to fit inside one of several bolt holes along side a fuel injector in a diesel engine. The locating pin serves as a pivot for the mechanic to manually lever the injector loose from the diesel engine.

U.S. Pat. No. 5,020,203 to Rix describes a high pressure fuel injector installation and removal tool for use on internal combustion engines which can be used to precisely locate the fuel injector during installation. The installation tool provides an alignment guide, as well as the mechanical impulse necessary to fully seat the fuel injector in the base cavity. The alignment guide forms a location skirt with projected ears around the perimeter of the fuel injector during the installation procedure and thus provides a means to assure sufficient clearance between the fuel injector and surrounding components without need for visual alignment.

U.S. Pat. No. 6,978,527 to Oser teaches a fuel injector remover for removing a fuel injector from a cylinder head wherein the fuel injector is located within a counterbore of the cylinder head. The remover includes a primer mover having a piston defining a central bore. A snout portion is attached to the prime mover and defines a central bore. The snout portion has a first end attached to the prime mover and a second end defining a tapered portion sized such that when the tapered portion abuts an outer diameter of the cylinder head counterbore, the prime mover is centered over the fuel injector. A puller rod extends through the central bores of the piston and the snout. A thumbscrew is provided for attachment to the threaded end of the puller rod after the puller rod has been inserted through the central bore of the cylinder.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved tool for removal of fuel injectors from the cylinder head of a diesel engine. The inventive apparatus includes a male threaded pulling shaft portion preferably having a milled or otherwise faceted top or head, with a female threaded connector member at the bottom for releasable connection to the male threads at the top of a typical fuel injector. A sleeve portion fits over the threaded pulling shaft so that the base of the sleeve rests against the cylinder head, and the top of the threaded pulling shaft extends through the top of the sleeve. A drive nut engages the threads of the pulling shaft and can be threaded down the pulling shaft until the drive nut contacts the top of the sleeve, preferably adjacent an interposed washer.

The inventive tool is used to remove a fuel injector from a cylinder head in the following manner. First, it is recommended that the mechanic use shop air to disperse dirt and debris away from the body of the injector unit to prevent the debris from entering the cylinder head upon removal of the injectors. Next, the fuel supply line and injector hold down nut are removed. The female threaded connector at the bottom of the threaded pulling shaft is then screwed on to the male threads on the top of the injector (tightening finger tight only).

Next, slide the sleeve over the threaded pulling shaft until the base of the sleeve rests on the top surface of the cylinder head, and carefully thread the drive nut onto the threaded pulling shaft extending through the top of the sleeve. Using an open end wrench or other tool on the milled head of the pulling shaft to prevent it from rotating, thread the drive nut down the body of the threaded pulling shaft until it contacts the washer at the top of the sleeve. Next, use an open end wrench to turn the drive nut against the sleeve, thereby lifting the threaded pulling shaft relative to the sleeve and removing the injector from the cylinder head. Finally, unscrew the injector from the female threaded connector at the bottom of the pulling shaft.

It is therefore an object of the present invention to provide a new and improved tool for removal of fuel injectors from the cylinder head of a diesel engine.

It is another object of the present invention to provide a new and improved fuel injector removal tool that does not require the use of a slide hammer.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
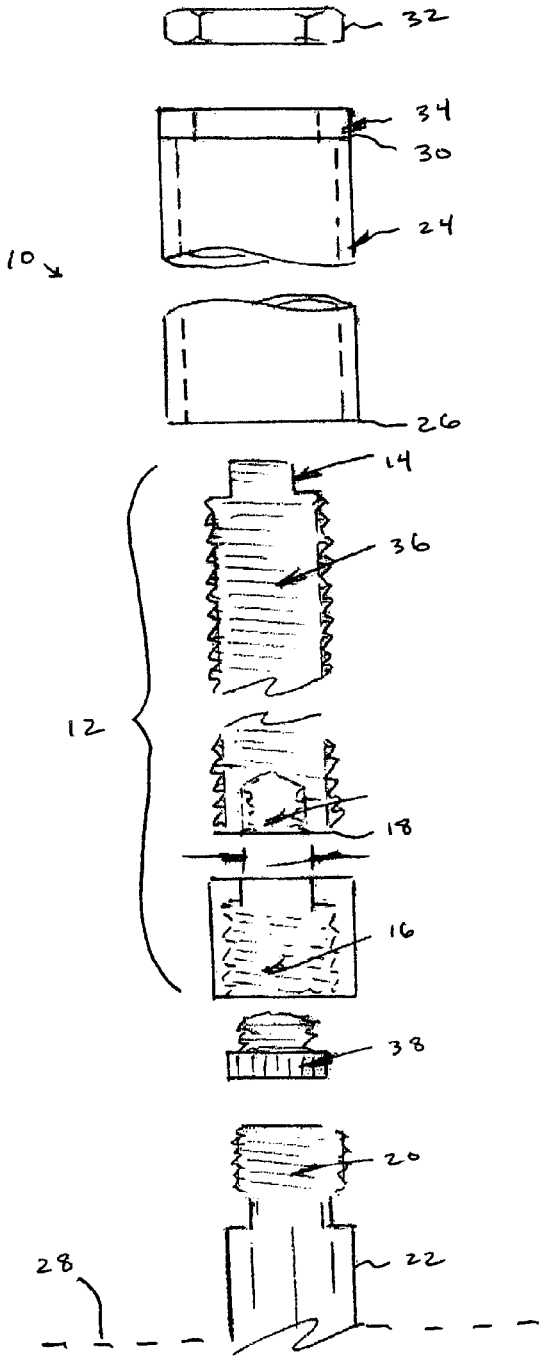
FIG. 1 is a partially cutaway exploded view of a diesel fuel injector removal tool of this invention.
Figure 2:
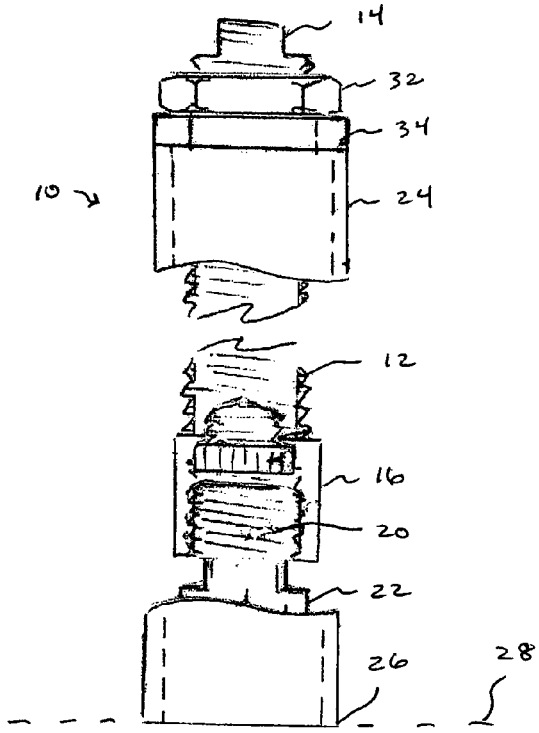
FIG. 2 is a partially cutaway view of the diesel fuel injector removal tool of this invention connected to and removing a fuel injector from a cylinder head.

Referring to FIGS. 1 and 2, wherein like reference numerals refer to like components in the various views, there is illustrated therein a new and improved diesel fuel injector removal tool, generally denominated 10 herein.

FIG. 1 is a partially cutaway exploded view of a first preferred embodiment of the diesel fuel injector removal tool 10, comprising a male threaded pulling shaft portion 12 (e.g., 3 1/16th inch long, 5/8-18 NF thread) preferably having a milled or otherwise faceted top or head 14 (e.g., milled for 7/16 inch wrench), with a female threaded connector member 16 at the bottom 18 (e.g., 1 1/4 inches long, with a 14×1.5 mm internal thread, but can be modified to fit other fuel injectors) for releasable connection to the male threads 20 (e.g., the 14 mm threads on a 1998 Cummins 5.9 diesel engine) at the top of a typical fuel injector 22. A sleeve portion 24 (e.g., 4 inches long, 1 inch diameter tubing with 0.062 inch wall thickness) fits over the threaded pulling shaft so that the base 26 of the sleeve rests against the cylinder head 28, and the top 14 of the pulling shaft 12 extends through the top 30 of the sleeve 24. A drive nut 32 (e.g., 5/8-18 NF thread) engages the threads of the pulling shaft 12 and can be threaded down the pulling shaft until the drive nut contacts the top 30 of the sleeve, preferably adjacent an interposed washer 34 (e.g., 5/8 inch SAE).

The threaded pulling shaft may be constructed as a threaded body 36 with a milled head 14, with the bottom drilled and tapped (e.g., 5/16-18 center bore thread) to accept a cap screw 38 (e.g., 5/16-18×3/8 inch Allen head cap screw) used to affix the female threaded connector 16 to the bottom 18 of the threaded body 36.

FIG. 2 is a partially cutaway view of the diesel fuel injector removal tool 10 of this invention connected to and removing a fuel injector 22 from a cylinder head 28. The female threaded connector 16 at the bottom of the threaded pulling shaft 12 is screwed on to the male threads 20 on the top of the injector 22 (tightening finger tight only). Next, the sleeve 24 is placed over the threaded pulling shaft 12 until the base 26 of the sleeve rests on the top surface of the cylinder head 28. Drive nut 32 is carefully threaded onto the top of the threaded pulling shaft 12 extending through the top of the sleeve 24. Using an open end wrench or other tool on the milled head 14 of the pulling shaft to prevent it from rotating, the drive nut 32 is threaded down the threaded pulling shaft 12 until it contacts the washer 34 at the top of the sleeve 24. An open end wrench is then used to turn the drive nut 32 against the sleeve 24 (and washer 34), thereby lifting the threaded pulling shaft 12 relative to the sleeve 24 and removing the injector 22 from the cylinder head 28. The injector 22 can then be unscrewed from the female threaded connector 16 at the bottom of the pulling shaft 12.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A tool for removal of a fuel injector having male threads from a cylinder head of a diesel engine, said tool comprising:

a male threaded pulling shaft portion having a top and a bottom, said top including a milled head for engagement by a wrench, and a female threaded connector member at said bottom adapted for releasable connection to the male threads of the fuel injector;

a sleeve portion having a top and a base, said sleeve portion adapted to fit over said male threaded pulling shaft portion so that said sleeve portion base rests against the cylinder head, and said male threaded pulling shaft portion top extends through said sleeve portion top; and a drive nut adapted to engage said male threaded pulling shaft portion and be threaded down said male threaded pulling shaft portion to contact said sleeve portion top, wherein turning said drive nut relative to said male threaded pulling shaft portion while engaging said milled head with a wrench to prevent rotation of said male threaded pulling shaft lifts said male threaded pulling shaft portion relative to said sleeve portion and removes the injector from the cylinder head.

2. The tool of claim 1 wherein said sleeve portion top includes a washer.

* * * * *